United States Patent [19]

Kmonk et al.

[11] Patent Number: 4,474,727

[45] Date of Patent: Oct. 2, 1984

[54] ARRANGEMENT FOR STORING SPENT NUCLEAR FUEL RODS AT A REACTOR SITE

[75] Inventors: Stanley Kmonk, Plum Borough; John M. Shallenberger, O'Hara Township, Allegheny County; Stephen J. Ferlan, Wilkins Township, Allegheny County, all of Pa.

[73] Assignee: Westinghouse Electric Corp., Pittsburgh, Pa.

[21] Appl. No.: 402,004

[22] Filed: Jul. 26, 1982

Related U.S. Application Data

[63] Continuation-in-part of Ser. No. 276,387, Jun. 22, 1981, which is a continuation of Ser. No. 905,671, May 15, 1978, abandoned.

[51] Int. Cl.[3] ..... G21C 19/00

[52] U.S. Cl. ..... 376/272; 29/400 N; 29/468; 53/246; 206/443

[58] Field of Search ..... 376/272; 250/506.1, 250/507.1; 29/400 N, 419, 467, 468; 141/1, 311 R, 325, 326, 327; 53/236, 246, 247, 257, 263, 443, 444, 471, 475; 206/821, 443; 220/86 R

[56] References Cited

U.S. PATENT DOCUMENTS

| | | | |
|---|---|---|---|
| 3,807,018 | 4/1974 | Ehrman et al. | 29/400 N X |
| 4,056,920 | 11/1977 | Shields | 53/246 X |
| 4,209,420 | 6/1980 | Larker | 376/272 X |

FOREIGN PATENT DOCUMENTS

| | | | |
|---|---|---|---|
| 0005623 | 11/1979 | European Pat. Off. | 376/272 |
| 2259669 | 6/1974 | Fed. Rep. of Germany . | |
| 1393704 | 2/1965 | France . | |
| 1555657 | 1/1969 | France . | |
| 2006621 | 12/1969 | France . | |
| 2171163 | 9/1973 | France . | |
| 2317127 | 2/1977 | France . | |
| 0148695 | 12/1978 | Japan | 376/272 |
| 0924013 | 4/1963 | United Kingdom . | |
| 0603611 | 4/1978 | U.S.S.R. | 206/443 |

*Primary Examiner*—Richard E. Schafer
*Assistant Examiner*—Daniel Wasil
*Attorney, Agent, or Firm*—D. E. Erickson

[57] ABSTRACT

Apparatus and method for providing on-site storage of all spent fuel rods removed from a nuclear reactor during its lifetime. Spent fuel rods are removed from spent fuel assemblies and stored in a container in a vertical position, and on a pitch which is less than the pitch of the fuel rods when in a fuel assembly. The removed fuel rods preferably are positioned in a triangular array, and with most fuel rods having line contact along their length with adjacent fuel rods. This arrangement imparts support to all fuel rods in the container and thereby maximizes the available storage space for fuel. To facilitate the loading process, the vertically disposed fuel rods may be installed on steps in the container or on a flat bottom plate therein, all with the assistance of a guidance plate which orients and directs each fuel rod into the container. Skeleton components in the fuel assembly, such as grids, used for holding the fuel rods in position are either cut or squeezed into small volume sections and stored in similar containers at the reactor site, or alternatively, shipped to burial sites.

8 Claims, 11 Drawing Figures

ARRANGEMENT FOR STORING SPENT NUCLEAR FUEL RODS AT A REACTOR SITE

CROSS-REFERENCE TO RELATED APPLICATIONS

This is a continuation-in-part of application Ser. No. 276,387, filed June 22, 1981, which was a continuation of application Ser. No. 905,671, filed May 15, 1978, which has been abandoned.

BACKGROUND OF THE INVENTION

The invention described herein relates to nuclear reactor spent fuel storage pools and more particularly to an arrangement for providing on-site storage of all spent fuel rods removed from a reactor during its lifetime.

In the operation of conventional nuclear reactors used for generating electric power, the nuclear fuel becomes spent and must be removed at periodic intervals. Although refueling schedules vary, approximately one-third of the fuel assemblies must be removed annually so that replacement of all fuel assemblies in the core will take place over about a three-year period. Since nuclear reactors are designed for a life extending to approximately forty years, it is apparent that spent fuel storage facilities at the reactor site must accommodate about thirteen full cores of fuel assemblies, i.e., about twenty-six hundred fuel assemblies to accommodate all discharged fuel.

Currently, there is a dearth of fuel reprocessing facilities in the United States and throughout the world. Since the fuel reasonably cannot be reprocessed, the electric utilities who remove spent fuel assemblies from their nuclear reactors must provide for their safe storage so long as the fuel therein remains radioactive.

Historically, utilities have always provided fuel storage areas alongside the reactor to accommodate a small number of fuel assemblies. However, in view of the present uncertainties regarding reprocessing fuel and shipping spent fuel from the reactor site, utilities recently have taken positive steps to increase their on-site fuel storage capacities. As presently designed, the plant construction generally precludes increasing the actual size of spent fuel storage pools so other alternatives have been examined to determine how the storage capacity can be increased. As a result, an increase in capacity has been accomplished by locating fuel storage racks on a closer pitch in the spent fuel pool, to thereby increase the number of fuel storage racks in the available space. Although the fuel storage capacity is greater, present storage pools at most reactor sites will not accommodate all the fuel expected to be removed from a reactor over its lifetime, unless new structures or methods are developed. Since such space reasonably will not be available, an increase in spent fuel assemblies beyond that capable of being absorbed by the fuel pits could result in shutdown situations for particular reactor plants, and especially if off-site storage facilities also are not available. It therefore is apparent that the need exists for alternative structures and methods for storing spend fuel recovered from currently operating nuclear reactors.

SUMMARY OF THE INVENTION

Briefly stated, the above disadvantages of the prior art are overcome by providing an apparatus and method capable of extending the capacity of spent fuel storage pools at the operating site of a given reactor plant. After fuel assemblies are removed from the reactor and permitted to decay in spent fuel pits, the fuel rods of each assembly are removed and stored in a container in a predetermined fashion. The fuel rods are compacted in a tight pitch array, i.e., on a pitch which is less than fuel rod pitch in a fuel assembly in special fuel rod storage containers which are then placed in spent fuel storage racks, or in a more space-efficient support system for indefinite on-site retention.

BRIEF DESCRIPTION OF THE DRAWINGS

The subject matter of the invention is particularly pointed out and distinctly claimed in the concluding portion of this specification. This invention, however, both as to organization and method of operation, together with further objects and advantages thereof, may best be understood by reference to the following description, taken in connection with the accompanying drawing, wherein:

DESCRIPTION OF THE PREFERRED EMBODIMENT

Figure 1:
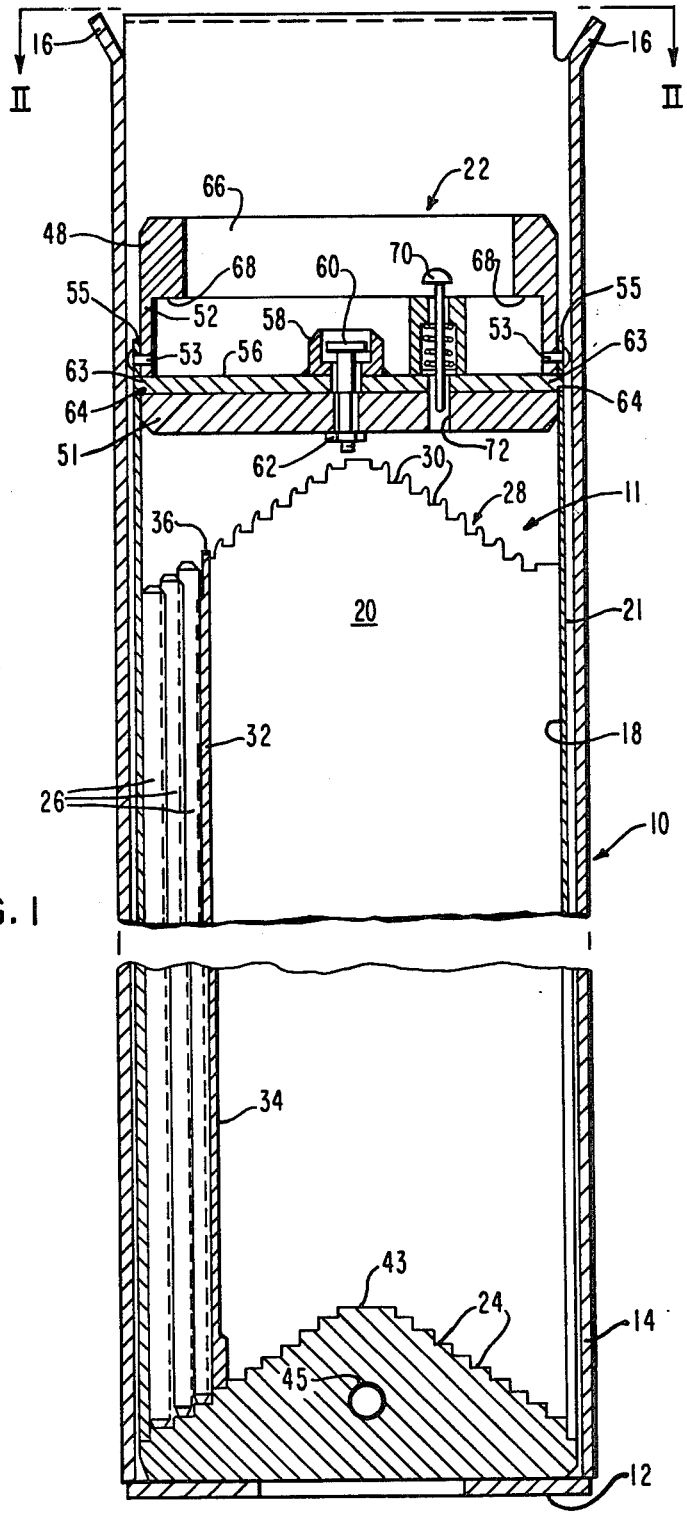
FIG. 1 is a view in elevation, partly in section, illustrating the design of a container located inside a spent fuel assembly storage rack, and which is used for holding a compacted array of fuel rods.
Figure 2:
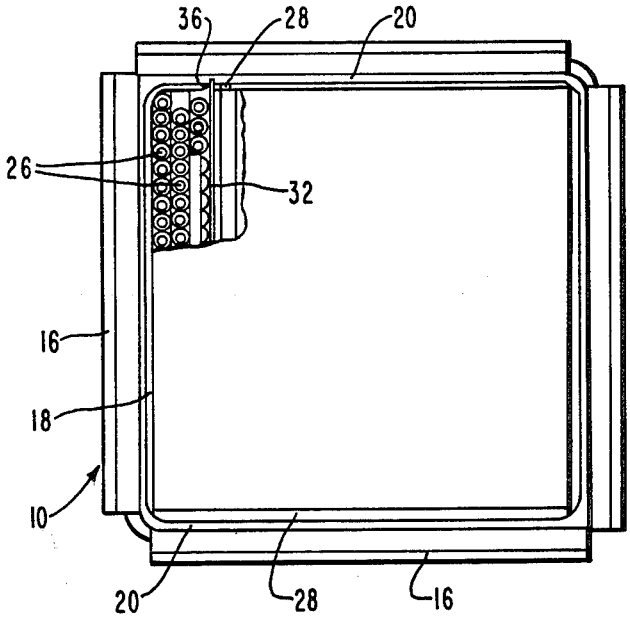
FIG. 2 is a partial view taken on lines II—II of FIG. 1 with the top cover removed, illustrating how a guiding plate is used for aligning fuel rods in the container illustrated in FIG. 1.
Figure 3:
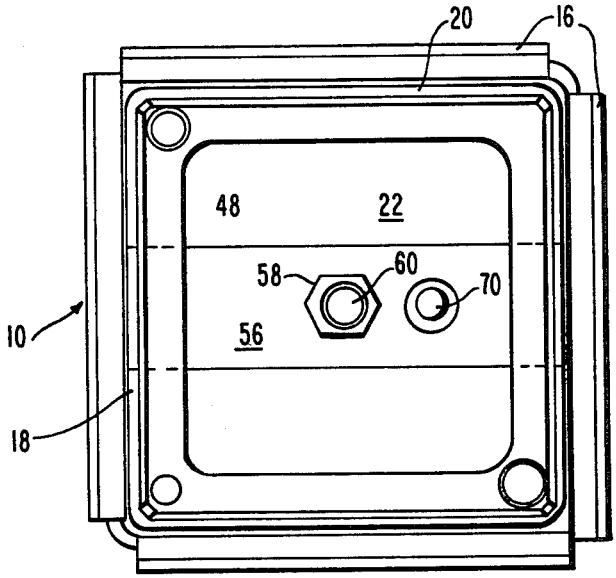
FIG. 3 is a plan view of the container of FIG. 1.

Referring now to the drawings wherein like reference characters designate like or corresponding parts throughout the several views, there is shown in FIGS. 1—3 a fuel storage rack cell 10 of stainless steel or other non-corrosive material designed to receive a container 11 arranged to hold spent fuel rods removed from spent fuel assemblies used in a nuclear reactor. The fuel rack 10 is essentially square in cross-section and includes a base 12 having side walls 14 which usually is positioned in a spent fuel pool for receiving an entire fuel assembly. The upper ends of the walls have outwardly extending flanges 16 used for helping guide a fuel assembly into the cell. This design of fuel rack conventionally is located in a spent fuel pool or pit. It may be retained therein to receive the container 11 of this invention, or the fuel racks may be completely removed, thus leaving only containers in the spend fuel pits.

As is well known to those skilled in the art, fuel rods are held in spaced relationship with each other in a fuel assembly by grids spaced along the fuel assembly length. These rods are on a pitch which is determined by the grids. As used herein, the term "fuel rod pitch" means the distance between the centers of adjacent fuel rods, whether in a fuel assembly or storage container. One of the major aims of this invention is to achieve a reduction in the pitch of spent fuel rods from that which existed in the spend fuel assembly from which the spent fuel rods were removed, to thereby increase the storage capacity of a spent fuel storage pool.

To meet this objective, container 11 is arranged to be stored in the fuel rack cell, with the small space 21 therebetween being used to accommodate flow of coolant through the container or the space may be left void for reactivity purposes. It is not essential that the container be located within the fuel rack cell since it is designed as a single entity with sufficient structural integrity to independently perform a fuel rod storage function. FIG. 1 shows that the side walls 18 of the container 11 extend upwardly above the end walls 20 to receive a cap 22, more fully described hereafter. Located inside the container 11 and supported on the bottom plate 12 is a stepped pyramidal type of support having steps 24 which rise from each of the side walls 18 to the center of the container. The purpose of these steps is to receive and support multiple rows of fuel rods which are positioned vertically on each step, as indicated in FIG. 2.

Since the objective is to store as many fuel rods as reasonably possible in the space provided inside the container, all the fuel rods are nested together in a triangular array or in a square array, such that any one fuel rod is in substantially full line contact along its length with fuel rods in the same row and in full line contact with adjacent fuel rods in each of the rows on opposite sides thereof, as clearly shown in the upper part of FIG. 2. As used herein and in the claims, the term "substantially full line contact" means that most fuel rods in the container will have line contact along their length with adjacent fuel rods, and those instances where full line contact is not made results from differences in diameter from rod to rod, differential thermal expansion of the rods, and bow which occurs along the length of some fuel rods.

Fuel rods of the type shown in FIGS. 1–3 used in contemporary reactors for electric power producing purposes, are long, thin rods, measuring less than about one-half inch in diameter, and up to fourteen feet in length. These dimensions may vary, however, and depend on the particular design of fuel assembly used in a particular design of reactor. Although each fuel rod has great strength in compression, it is difficult to handle because it is extremely flexible and will remain in a vertical position only when laterally supported along its length. For this reason, the fuel rods cannot be loaded conveniently into the container without support because of the likelihood of buckling along their length.

Figure 5:
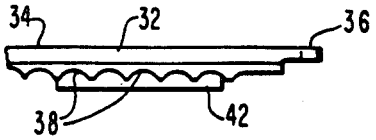
FIG. 5 is a plan view of the guidance plate illustrated in FIG. 4.

The container in FIGS. 1–3 is therefore especially designed to accommodate the flexibility in fuel rods and permit quick, efficient loading in minimum time. As shown in FIGS. 1 and 2, the end walls 20 in opposite sides of the container are shorter than the side walls 18 and extend upwardly only so far as is shown by the stepped portion 28 shown in FIG. 1. These channels 30 which lie directly above the corresponding steps 24 in the base appear on the top of both end walls 20. An alignment plate 32 shown in FIGS. 1 and 4–6, carries a support bracket 36 arranged to rest in the channels 30 appearing on each of the end walls 20. The alignment plate extends the complete length of the container and is slightly higher than the length of a fuel rod, as shown in FIG. 1. The back side 34 of the plate is flat, as shown in FIGS. 1 and 5, and the ends 36 are of hook-shaped design to fit into the corresponding channels 30 formed on top of end wall 20. The side of the plate facing the fuel rods is equipped with multiple grooves 38, each of a size complementary to the fuel rods to be loaded into the container. This side of the plate also carries a leaf spring 40 which projects outwardly beyond the grooved face and in a position to engage each fuel rod as it is loaded into the container. The spring contains a pin and slot arrangement 41 which permits the spring to compress and flatten out, and ride on the pin, when engaged by a fuel rod. Each spring may be attached separately in a groove 38 or it may span several grooves.

As loading of the fuel rods commences, the alignment plate 32 is placed in position in the first channels 30 formed on the left side of the container as it is viewed in FIG. 1. Each fuel rod is then separately loaded into the container. Since the fuel rod is highly flexible, it is caused to ride in a groove 38 by the action of spring 40, and since the other side of the fuel rod lightly engages the side of the container, it is guided downwardly into the container until the bottom end thereof rests on the first step 24 on the base. The next fuel rod is similarly loaded into the container, and these rods, together with those rods later loaded into the first row in the container, are all supported by the side wall 18 and the corresponding grooves 38 and springs 40 formed in the alignment plate 34. Since the rods are fully supported, they will not buckle.

After the first row is filled with fuel rods the alignment plate 32 is moved to the next channel 30 to provide space for loading a second row of fuel rods into the container. In so doing, the spring 40 will ride outwardly from the grooved face on pin 41 and into the position shown in FIG. 6 where it effectively will hold the fuel rods in an upright position without buckling. The bulge 42 stays in this position until it is again moved inwardly by a fuel rod. This arrangement prevents the rods from moving out of position and, importantly, provides an open area between the row of fuel rods just loaded into the container and the grooved surface of the alignment plate. This area is just sufficient to accept the second row of fuel rods.

The alignment plate is then lifted and the ends 36 thereof placed in the next set of channels 30 on top the opposite end walls 20. Since the distance between the grooves 38 on the face of the alignment plate and the fuel rods just loaded into the first row is less than one-half inch, and since each of the fuel rods are in substantial line contact with each other along the length of the row, the fuel rods will not deform to a point where loading of the second rod will be precluded because of buckling or other reasons. The second row of fuel rods is loaded such that the axis of the fuel rod being loaded in a column 2, falls between the axis of the two adjacent rods in row No. 1, as shown in FIG. 2. As the first fuel rod is loaded into the second row, it establishes line contact with the two adjacent fuel rods in the first row on one side, and engages the groove 38 and spring bulge 42 on the alignment plate on the other side of the fuel rod. The next fuel rod is similarly loaded, and in addition to making line contact with two adjacent fuel rods in the first row, also makes line contact with the fuel rod just previously loaded in row No. 2. The pattern of loading is on a triangular pitch basis where the pitch between fuel rods is less than that appearing in a fuel assembly. By loading the fuel rods in the container in this fashion, substantial support is provided to each fuel rod immediately upon its being loaded into the container and that support reamins until the alignment plate is moved to the next row, where the process is again repeated, until all rows are full on the left side of the container, except the top row.

The alignment plate is then moved to the right side of the container and a first row is loaded in the same manner as previously described relative to the loading of the first row on the opposite side of the container, and then the second row, and so on, until all rows are full except the top row. Two rows are then loaded on the ledge 43. At this time, the alignment plate 34 is removed, and since the only space remaining is that equal to the width of the plate, a dummy plate may be inserted in the void space, if desired, or it may be left open and thus provide some degree of looseness in the assembly.

A conventional fuel assembly of the type used in pressurized water reactors contains fuel rods having a diameter of 0.372" and the rods are spaced on a 0.496" pitch. When all rods are removed from an assembly and loaded on a triangular pitch in a container, as described above, a better than 2:1 ratio in the storage of fuel rods is obtained. Since more than twice as many fuel rods can be stored in the same square foot space as that occupied by a fuel assembly, it is evident that great savings in storage space will be made at the reactor site. Likewise, conventional boiling water reactor fuel assemblies contain fuel rods of 0.483" diameter placed on 0.638" pitch. When these fuel rods are stored on a triangular pitch, the pitch essentially will be the same as a fuel rod diameter because the rods are in substantially full line contact along their length. Storage of the rods as described above will provide more than a 2:1 storage ratio, thus resulting in space savings as described above.

It will be apparent that the steps which appear in the step base 24 are not of a width equal to the diameter of a fuel rod because, as shown in FIG. 2, the fuel rods in the second and succeeding rows are nested between two adjacent fuel rods in the preceding row, and the step therefore should not be equal to the width of a fuel rod, because otherwise a space will remain between the bottom of the fuel rod and the step portion on the base.

After the container is fully loaded with fuel rods, the top cap 22 is placed in the container and locked in position, thus providing a structure having the same design as the top nozzle of a fuel assembly, thereby permitting the container to be lifted by the same lifting apparatus which lifts fuel assemblies into and out of the reactor. The top cap includes a lifting section 48 integrally joined with a bottom plate 50 by side walls 52. This top cap unit is held in place by a pair of oppositely disposed rotatable pins 53 which extend from the top cap side walls 54 into the side walls of the container. Since these pins carry only the load of the top cap, they may be made of relatively small diameter, and preferably are spring-loaded to facilitate the insertion and removal of the top cap.

A rotatable lock plate 56 is slidably mounted on the top surface of bottom plate 50 and carries a hex nut 58 which is welded or otherwise affixed to the lock plate. To secure the lock plate to the bottom plate of the top cap assembly, a pin 60 extends downwardly through the lock plate and bottom plates and is welded at its bottom end to the channel provided in the center of the bottom plate, or the lock plate 56 is removably held in the bottom plate 50 by nut 62. As shown in both FIGS. 1 and 3, the lock plate ends 63 are sufficiently long to extend into slots 64 formed in the side walls of the container. It will be apparent that as the ends 63 of the lock plate 56 are rotated into slots 64 on the container, i.e., from a diagonal position to a locked position, as indicated in FIG. 3, the cap will be firmly locked to the container thus sealing the container and allowing the cap to perform a load carrying function. The upper portion of the top cap further is provided with an opening 66 and flanges 68 which are designed to be engaged by the lugs of a fuel assembly lifting mechanism to lift and transfer the container from one area to another at the reactor site. Spring biased pin 70 extends downwardly into hole 72 in base plate 50 to preclude inadvertent unlocking of the cap after it is secured to the container.

It will be apparent that the top of the cap preferably should correspond to, or be complementary to, the design of lifting lugs on a lifting mechanism. The cap therefore may contain openings in its upper section, for example, to permit access of lifting lugs to the underside of the cap.

In the modification of FIGS. 7–11 the stepped base and stepped end walls are eliminated and an entire box-like container having a flat base is provided. The container comprises a base 12 and side and end walls 18, 20. Instead of a stepped base, the baseplate 12 may be flat or it may be equipped with holes 50 aligned in rows along the container depth and are of a size slightly larger than the end of a fuel rod. The depth and spacing of the recessed holes are such that when the end of a fuel rod is inserted therein, it will not thereafter move laterally. Since the recessed holes intersect at tangent points, each fuel rod will have substantial line contact along its length with fuel rods on opposite sides thereof and with those fuel rods in the next adjacent rows. It is evident that the fuel rods may be mounted directly on the flat base instead of using the recessed holes. However, additional time may be needed to achieve precision in the storage arrangement and to help assure substantially full line contact between adjacent fuel rods.

Figure 4:
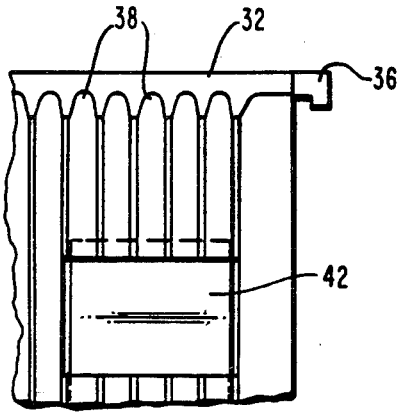
FIG. 4 is a partial view in elevation showing a section of the guiding plate used for orienting fuel rods in FIG. 2.
Figure 10:
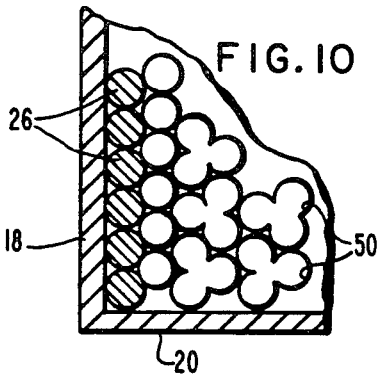
FIG. 10 is a view taken on lines X—X of FIG. 9.
Figure 9:
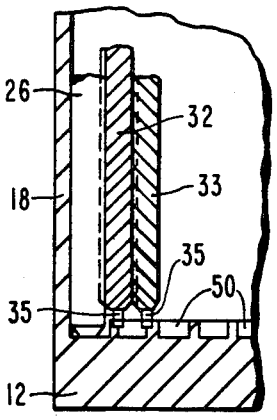
FIG. 9 is a detailed view illustrating how fuel rods are positioned in openings provided in a bottom plate in the container of FIG. 7.

The top surface of end walls 20 are serrated to provide channels which receive the flanged ends 36 of alignment plate 32 illustrated in FIGS. 1, 4 and 5. However, the bottom end of each of two alignment plates 32, 33 are equipped with a chamfered end 54, one on each end, which engage corresponding holes 50 in the base. When the plates 32, 33 are placed in position for loading fuel rods, the space thus provided between the face of the first alignment plate and the container wall, or a previously installed row of fuel rods, will be just sufficient to accept the fuel rods and guide them into position.

Figure 6:
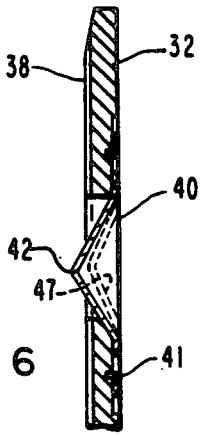
FIG. 6 is a side view of the plate of FIG. 4.

As indicated previously, although each fuel rod will withstand substantial compressive forces, the rod is extremely flexible and rod guidance into its position in the container must be carefully carried out. When rods are ready to be loaded, a first alignment plate 32 which is essentially the same as that of FIGS. 4–6, is set into position with just sufficient space between the alignment plate grooved face and the container wall. The second plate 33 is then placed immediately behind the first plate such that its grooved face abuts the back of the first plate. The container is then tilted at a slight angle a, up to about 15°, and the fuel rods then loaded into the low side of the container. The tilt provided by the container is just sufficient to furnish a container surface against which a fuel rod may slide, or at least slightly contact, to help minimize unwanted bending or lengthwise radial distortion which otherwise could be caused by a swaying fuel rod. The grooves 38 together with springs 40, on the face of alignment plate 32 also serve to help keep the fuel rod in vertical alignment as it enters the container while maintaining line contact with the preceding rod in the same row, and finally nests in its corresponding hole in the container bottom.

After the first row is filled, the first plate which has been occupying the space provided for the second row of fuel rods, is removed and installed behind the second plate 33 which is in the third row. The two alignment pins 35 on the first plate enter the fuel rod holes in row number 4 to thereby immovably locate the first plate in a fixed position. When this plate transfer takes place, bulge 42 of spring 40 on the second plate, moves from its housed position, shown by dotted lines 47 in FIG. 6, to its fully projected position illustrated by the full lines in FIG. 6. Bulge 42 thereupon engages the sides of the fuel rods and holds them in an unbuckled vertical position. When the grooved face of first plate 32 engages the back of second plate 33, spring 40 in plate 32 engages the back of plates 33 and is again moved to a housed position. The spring 40 makes an angle of about 10° with the back 34 of the guidance plate. Although a pin and slot arrangement 41 is used, the pin may be eliminated to permit the spring to move in response to contact either by fuel rods or the back of the other plate.

The second plate then serves as a guidance means for guiding the second row of fuel rods into position as they are loaded into the container. This loading procedure continues until all fuel rods, including those in the last row, are loaded into position. As in the modification of FIG. 1, the cap 22 is then placed in the top of the container and locked in position in the manner previously described. The container with its load of fuel rods is then stored in a spent fuel pit which includes borated water or other neutron capturing material designed to prevent fissioning of any remaining uranium atoms in the spent fuel.

The major benefits derived from the use of the compact storage assemblies described above is that the storage capacity at nuclear reactor plants having on-site storage facilities can be extended to accommodate all of the fuel rods removed from the reactor over its entire life. An indication of the benefits obtainable are apparent from the following table which suggests how storage capacity can be increased by providing for compact storage of the fuel rods. The estimates in this table are based on a reactor having on-site storage wherein the fuel pits are equipped with racks for holding fuel assemblies. It will be evident that the racks may be removed to provide even greater storage space than that indicated in this table.

TYPICAL INCREASED FUEL STORAGE POTENTIAL

| Style of Storage Racks | Rack Pitch | Years to Fill Racks With Fuel Assays.* | Years Est to Fill Racks With Compacted Rods* |
|---|---|---|---|
| Original Stainless Steel Design | 21" | 1 | 2 |
| Close-Spaced Stainless Steel Can Design | 13" | 9 | 17 |
| Current Proposed $B_4C$ Poison Design | 10.5" | 15 | 28 |
| Proposed Optimum Poison Design for Compacted Rod Storage | 10.5"-9.25" | — | 30 to 40 |

*Assumes Emergency Full Core Unloading Capability

Since commercial power reactors conventionally are designed for about a 30 year life span, it is evident that the design of fuel rod storage described herein will accommodate all of the spent fuel rods over the lifetime of the reactor.

The additional benefits which will flow from this design include the elimination of the need to ship spent fuel assemblies from a reactor area to a remote storage area which more than likely, will be located at a large distance from the reactor site. If spent fuel assemblies are stored at a remote site the possibility exists that the spent fuel which still has a useful life in a different type of reactor, may not be recoverable from the storage area. As reprocessing of nuclear fuel materializes and facilities are set in place for reprocessing purposes, the number of fuel shipments will not be as great as it would be if fuel assemblies alone were shipped to a reprocessing facility.

Figure 11:
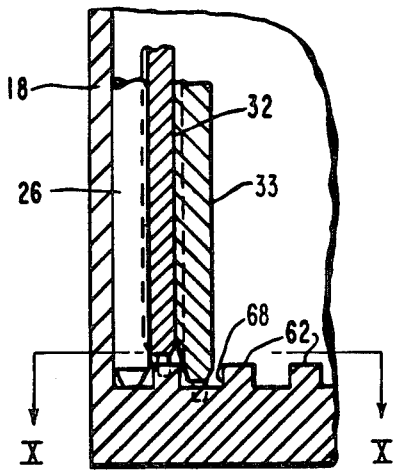
FIG. 11 is a modification of the base plate shown in FIG. 9.
Figure 8:
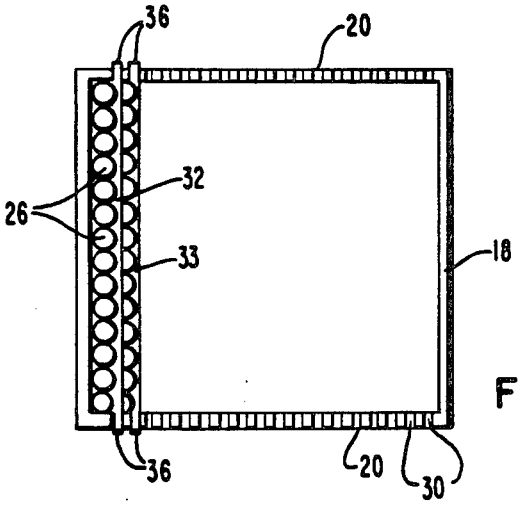
FIG. 8 is a plan view of the container of FIG. 7.
Figure 7:
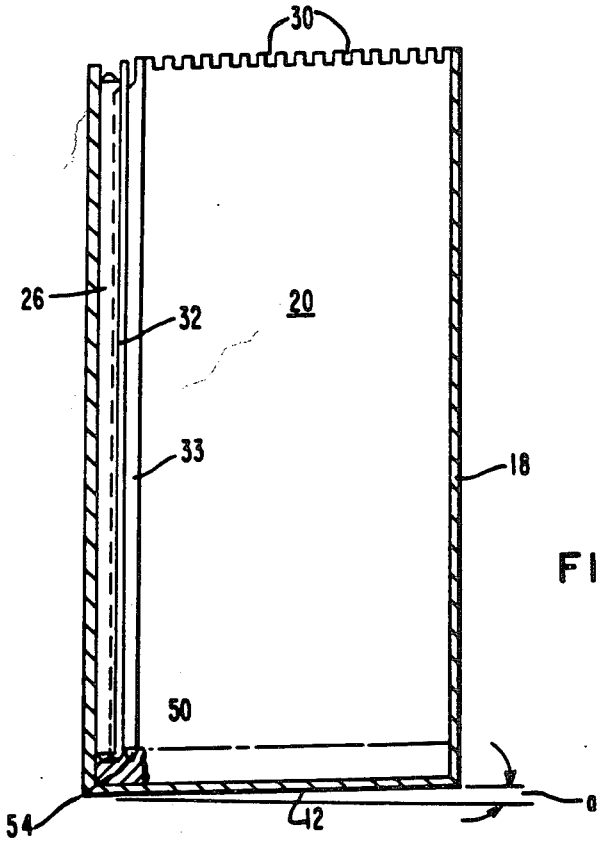
FIG. 7 is a modification of the storage container shown in FIG. 1.

In the base plate modification shown in FIG. 11, instead of using holes 50 to receive the chamfered ends of an alignment plate 32, 33, a series of parallel grooves 60 are machined in the container base plate. These grooves form pedestals 62 on which fuel rods also are placed. Since nesting of the fuel rods takes place, the grooves in the alignment plate face are shown by dotted lines in FIG. 11.

It will be apparent that many modification and variations are possible in light of the above teachings. It therefore is to be understood that within the scope of the appended claims, the invention may be practiced other than as specifically described.

We claim:

1. A storage device for storing spent fuel rods of a spent nuclear fuel assembly within which adjacent fuel rods are disposed on a fuel rod pitch comprising:

elongated enclosure means extending along the lengths of said spent fuel rods for receiving said spent fuel rods interiorly thereof, said enclosure means comprising a plurality of vertically extending walls forming the outer periphery of said storage device;

means for disposing said spent fuel rods within said enclosure means;

wherein said disposing means comprises a horizontally extending base of said storage device configured to support said spent fuel rods in rows within said enclosure means such that adjacent spent fuel rods in a row are in substantial line contact with each other along the length of said enclosure means;

wherein said fuel rods in one row are in substantial line contact with fuel rods in the next adjacent rows;

wherein said fuel rods in substantial line contact with each other in said enclosure are located on a generally equilateral triangular pitch;

wherein said container includes means for facilitating the loading of fuel rods therein, said means being constructed and arranged such that the fuel rods coact therewith to achieve substantially full line contact with each other in said container; and wherein said means includes a guidance plate extending at least generally a said fuel rod in length and removably mounted on opposite end walls in said container, said plate having grooves along its length which are complementary to the configuration of said fuel rods so that when fuel rods are loaded into the container, the fuel rods engage said grooves and are directed into alignment with adjacent fuel rods.

2. A storage device as recited in claim 1 wherein said guidance plate includes a spring which is biased outwardly beyond the surface of said plate for engaging the sides of fuel rods being loaded into the container and urging them into alignment with fuel rods previously loaded into the container.

3. A method of storing spent fuel rods of a spent fuel assembly within which adjacent fuel rods are disposed on a fuel rod pitch comprising the steps of:

removing said spent fuel rods from said spent nuclear fuel assembly;

disposing said spent fuel rods removed from said spent nuclear fuel assembly adjacent to each other in an elongated storage container;

wherein said disposing step comprises the step of disposing said spent fuel rods in said storage container such that adjacent spent fuel rods are in substantial line contact with each other along the length of said container;

wherein said disposing step includes placing a guidance plate extending at least generally a said spent fuel rod in length and having at least one lengthwise groove on a surface thereof in said container;

positioning said plate adjacent a wall of said container;

moving a fuel rod into said container in a manner such that it is guided into a position along said wall by the groove in said plate;

continuing the loading of fuel rods in said container to form a row of fuel rods having substantial line contact with each other along the container length;

moving said plate away from the thusly loaded row of fuel rods a distance sufficient to permit loading fuel rods between the first row of fuel rods and the plate; and loading a second row and subsequent rows of fuel rods into said container so that each fuel rod has substantial line contact along its length with at least one fuel rod in the preceding row, and line contact with adjacent fuel rods in the same row.

4. A method of storing as recited in claim 3 wherein the disposing step includes positioning the guidance plate in the container after loading the first row and orienting the plate such that the centerline of each groove in the plate is equidistantly offset from the axis of fuel rods in the preceding row;

loading fuel rods into the next and succeeding rows in a manner such that each fuel rod will nest between two adjacent fuel rods in the preceding row and thereby provide a compact array of fuel rods in the container.

5. A method of storing as recited in claim 4 including the steps of:

moving the guidance plate above a step at a different elevation than the preceding step after loading the preceding row of fuel rods until the plate reaches a step in the center of the container;

continuing the loading of fuel rods from the other side of the container by moving the guidance plate in the aforesaid manner; and removing the plate from said container and completing the loading of fuel rods therein.

6. A method of storing as recited in claim 4 including the steps of:

aligning fuel rod guidance grooves in the guidance plate with complementary openings formed in the base of the container; and positioning an end of each fuel rod in its complementary opening formed in the base to help assure the correct alignment of each fuel rod in the container.

7. A method of storing as recited in claim 4 including the steps of placing a second plate having grooves in its face surface behind the first plate used in guiding fuel rods into the container;

removing the first plate after a row has been filled with fuel rods and placing the first plate behind said second plate and in parallel relationship therewith;

continuing the loading of fuel rods into a new row until it becomes filled and thereupon moving the second plate behind the first plate, thus providing a space extending the length of said container for the reception of fuel rods in the next row; and continuing the loading of fuel rods in the aforesaid manner until the container is full.

8. A method of storing fuel rods into a container comprising the steps of:

tilting said container at an angle of up to about fifteen degrees with the vertical;

positioning a guidance plate in said container and within a distance from a wall thereof only slightly greater that the diameter of a fuel rod, said guidance plate extending at least generally a said fuel rod in length and having lengthwise grooves on its face complementary to the surface of a fuel rod;

moving a fuel rod into said container in a manner such that it contacts the tilted surface of the container and is simultaneously guided into the container by one of said grooves on the guidance plate surface;

continuing the loading of fuel rods in said container to form a row of fuel rods having substantial line contact with each other along the container length;

moving said plate away from the loaded row of fuel rods a distance sufficient to permit loading fuel rods between the plate surface and the row of fuel rods just loaded;

loading a second row and subsequent rows of fuel rods into said container so that each fuel rod has substantial line contact along its length with fuel rods in the preceding rows, and substantial line contact with adjacent fuel rods in the same row;

removing said guidance plate and loading the last row of fuel rods in said container; and selectively locking a cap on said container to enclose the fuel rods and permit container movement to different locations.

* * * * *